United States Patent [19]

Barlow et al.

[11] 4,091,995

[45] May 30, 1978

[54] TOY VEHICLE TRACK

[75] Inventors: Gordon A. Barlow, Evanston; Derek A. Brand, Naperville; Alex Imatt, Chicago, all of Ill.

[73] Assignee: Marvin Glass & Associates, Chicago, Ill.

[21] Appl. No.: 716,674

[22] Filed: Aug. 23, 1976

[51] Int. Cl.[2] ..... E01B 23/00; A63H 19/28

[52] U.S. Cl. ..... 238/10 A; 46/1 K; 238/10 F

[58] Field of Search ..... 46/1 K; 104/53, 60, 104/147 A; 29/453; 339/20, 21, 22 R, 66 R, 66 M, 75 M, 75 MP, 91 R, 61 R, 61 C, 61 L, 61 M, 252 R

[56] References Cited

U.S. PATENT DOCUMENTS

| | | | |
|---|---|---|---|
| 2,272,903 | 2/1942 | Bonanno | 339/66 M |
| 3,475,718 | 10/1969 | Hartz et al. | 339/91 R |
| 3,588,784 | 6/1971 | Kunkle et al. | 339/91 R |
| 3,711,816 | 1/1973 | Schumacher | 339/91 R |
| 3,854,405 | 12/1974 | Martin | 104/60 |

FOREIGN PATENT DOCUMENTS

| | | | |
|---|---|---|---|
| 1,576,999 | 8/1969 | France | 339/91 R |

*Primary Examiner*—Drayton E. Hoffman
*Assistant Examiner*—Carl Rowold
*Attorney, Agent, or Firm*—Mason, Kolehmainen, Rathburn & Wyss

[57] ABSTRACT

A trackway for toy vehicles which includes a plurality of elongated track sections placeable end-to-end and having upper surfaces defining a roadbed for the toy vehicles along the top of the trackway. The track sections have complementary engageable latch-release components on the ends thereof for connecting the track sections end-to-end and holding the track sections against separation, automatically in response to longitudinal pushing type abutment of the track sections against each other. In the disclosed embodiment, the latch-release mechanism includes a flexible portion formed integrally with each track section.

6 Claims, 8 Drawing Figures

TOY VEHICLE TRACK

BACKGROUND AND SUMMARY OF THE INVENTION

This invention relates to trackways for toy vehicles and, particularly, to a trackway for toy vehicles which includes a plurality of track sections placeable end-to-end to define a roadbed on the upper surfaces thereof extending lengthwise along the top of the trackway.

Trackways or roadbeds for toy vehicles have been provided for a considerable period of time for model trains, racing sets, or the like. Various means have been provided for connecting a plurality of track sections end-to-end so as to facilitate storage and shipping and yet provide a trackway of considerable length when assembled for use. One common expedient for connecting the track sections together end-to-end has been a simple telescopic connection whereby protruding rod-like stub shafts on the ends of certain track sections were insertable telescopically into tubular recesses of adjacent track sections. However, no means was provided to prevent the track sections from inadvertently becoming disengaged. One attempt to avoid inadvertent longitudinal displacement of the track sections has been to provide separate connecting members which, when positioned at the joint of adjacent track sections, engage the adjacent sections and held the same against longitudinal movement. In this instance, the track section had to be placed in longitudinal abutment and alignment and held in such alignment while the connecting members were placed in position. Yet further attempts at providing connecting means for such track sections while hold the track sections against longitudinal displacement have included providing enlarged ball or head-type members positionable in a vertical direction into receptacles in adjacent track sections.

The present invention is directed to providing a new and improved connecting means for the track sections which provide the roadbed for a trackway for toy vehicles or the like.

In the exemplary embodiment of the invention, each track section has a flexible arm protruding lengthwise from one track section at the outer side edge thereof and having a recess on the inside of the flexible arm for receiving a boss protruding laterally outwardly from the adjacent outside edge of an adjacent track section. Each track section has a flexible arm and rigid boss on the outside edges at each end thereof and so disposed that either end of one track section can be connected to either end of another track section. With the above described construction, two adjacent track sections need only be pushed together end-to-end in abutting engagement so as to connect the track sections together end-to-end and holding the track sections against inadvertent longitudinal separation. In order to separate the track sections, the flexible arms simply are moved manually outwardly from the track sections to move the recess on the inside of the arm away from the rigid boss of the adjacent track section where the track sections can be separated. Various features, such as abutting surfaces on the flexible arms and the adjacent track sections, as well as longitudinally protruding tabs and recesses at adjacent ends of adjacent track sections prevent the track sections from being canted about the transverse joint between the sections.

Other objects, features and advantages of the invention will be apparent from the following detailed description taken in connection with the accompanying drawings.

DETAILED DESCRIPTION OF THE INVENTION

Figure 1:
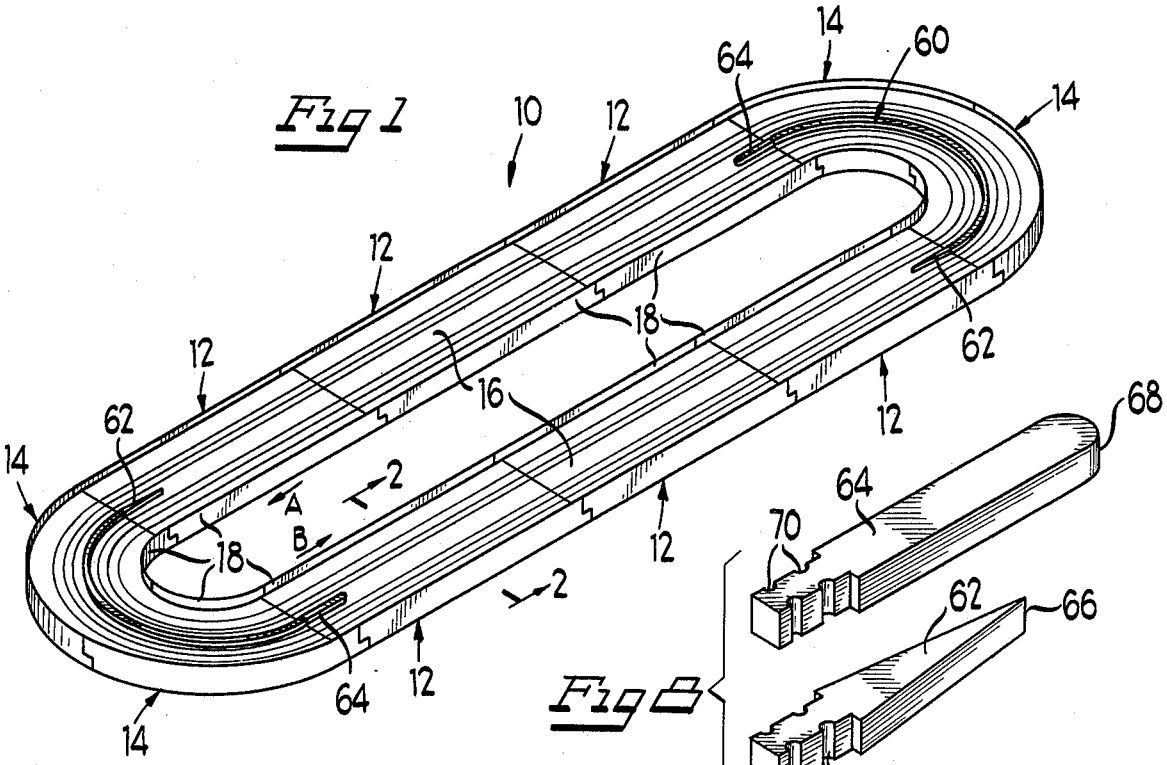
FIG. 1 shows a trackway for toy vehicles, or the like, in accordance with the concepts of the present invention.

Referring to the drawings in greater detail, and first to FIG. 1, a trackway, generally designated 10, for toy vehicles, or the like, is provided with a plurality of end-to-end track sections generally designated 12 and 14, having upper surfaces 16 (FIG. 2) defining a roadbed for the toy vehicles along the top of the trackway 10. The track sections 12 are straight sections and the track sections 14 are curved sections so as to be capable of providing various shapes or configurations of the trackway, such as the "oval" trackway shown in FIG. 1. The track section 14 shown in FIG. 1 comprises a 90° curve, but other degrees of curvature and any number of straight or curved track sections may be provided as desired.

Figure 2:
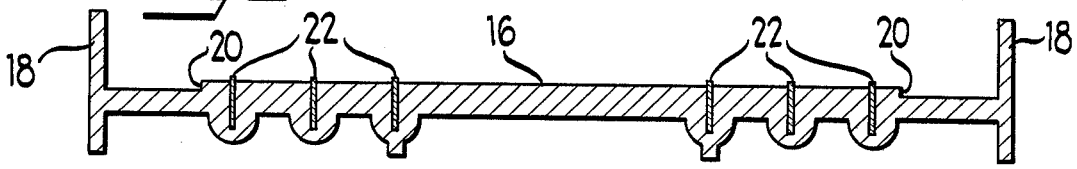
FIG. 2 is a vertical section, on an enlarged scale, taken generally along line 2—2 of FIG. 1.
Figure 3:
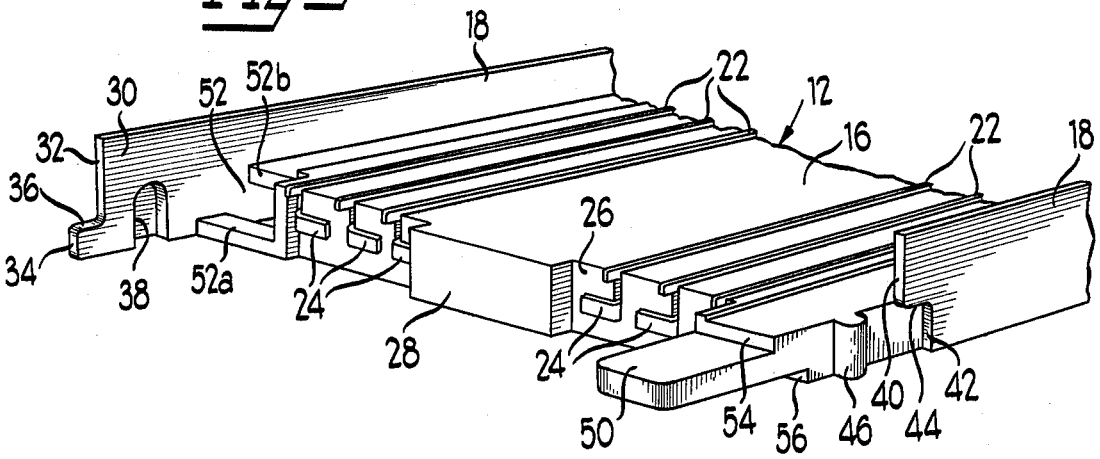
FIG. 3 is a fragmented perspective view of one end of one of the straight track sections shown in FIG. 1, on an enlarged scale.

Referring to FIG. 2, each track section has outer side walls 18 bounding the roadbed defined by the upper surfaces 16. The roadbed is recessed, as at 20, along the inside of the outer side walls 18 for receiving the outer or inner wheels (depending upon which track of the trackway is being traveled) of the toy vehicles.

As is known, power is supplied to the toy vehicles through elongated band-type contacts 22 which are "brushed" by contacts on the toy vehicles for supplying electrical energy thereto. As is shown in FIGS. 3 through 7, the contacts 22 are bent, as at 24, at opposite ends thereof for abutting engagement with the contacts of an adjacent track section so as to have continuous current from one track section to another. The bent portions 24 of the contacts 22 are disposed within recesses 26 between a center abutment 28 at the ends of the track sections.

A new and improved complementary engageable latch-release means on the ends of the elongated track sections 12 and 14 are provided for connecting the track sections end-to-end and holding the track sections against inadvertent longitudinal separation. More particularly, referring to FIGS. 3–7, a continuation of one outer side wall 18 of each track section (a section 12 being shown in FIG. 3) forms a flexible arm 30 preferably formed integral with the side wall and track section, such as with molded plastic or other appropriate materials. The flexible arm 30 terminates in an edge having offset vertical edge portions 32 and 34 and a horizontal edge portion 36. A recess 38 is formed on the inside of the flexible arm 30 as shown best in FIG. 3. The other outer side wall 18 opposite that forming the flexible arm 30 has a cutaway portion defining vertical edges 40 and 42 and a horizontal shoulder 44 for mating with the edges 32 and 34 and shoulder 36 of the flexible arm 30 of an adjacent track section.

A rigid boss 46 is formed integral with the track section so as to be disposable within the recess 38 of the flexible arm 30 of an adjacent track section, as is shown in FIGS. 4–7. As seen in FIGS. 3 through 7, the forward edge of the bosses 46 are curved or sloped so as to provide a camming edge for the vertical surface portion 34 of the flexible arms 30 of the adjacent track section so that adjacent track sections are connected together in a holding relationship simply by a longitudinal pushing action by a user whereby the flexible arms 30 snap over the rigid bosses 46 with the bosses 46 disposed within the recesses 38 of the flexible arms.

Figure 4:
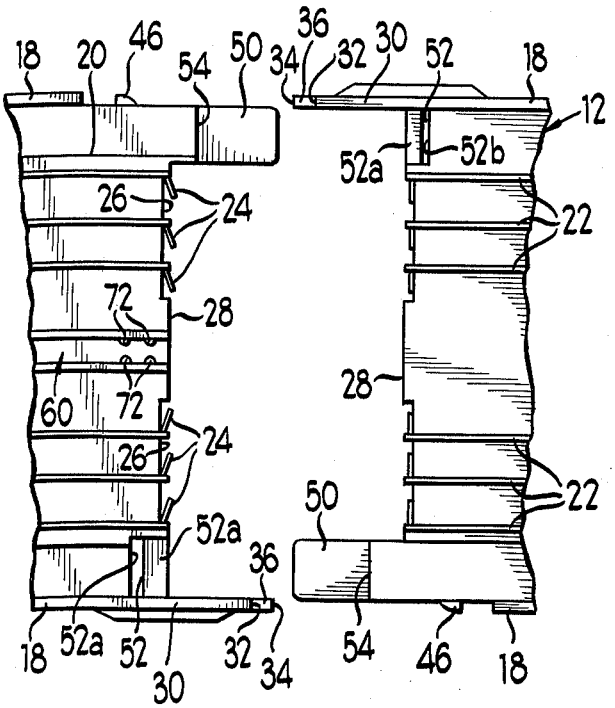
FIGS. 4 through 7 are sequential fragmented top plan views showing the disposition of the various components at adjacent ends of adjacent track sections as the sections are connected together by longitudinal abutting movement toward each other.
Figure 5:
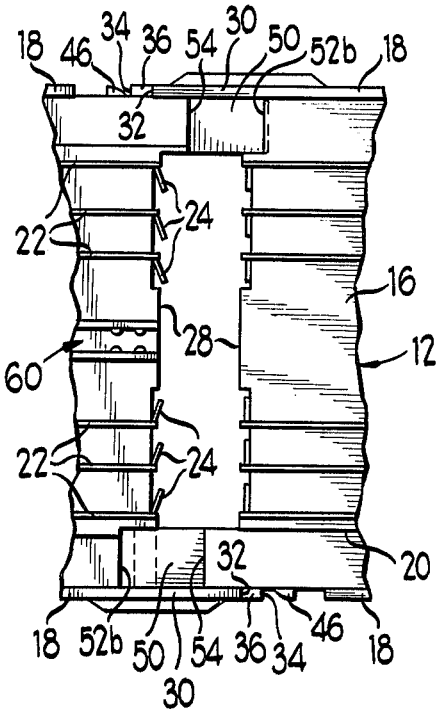
Figure 6:
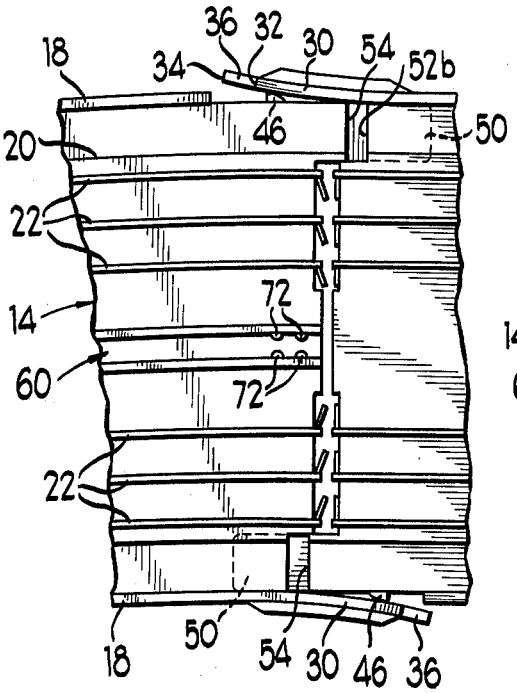
Figure 7:
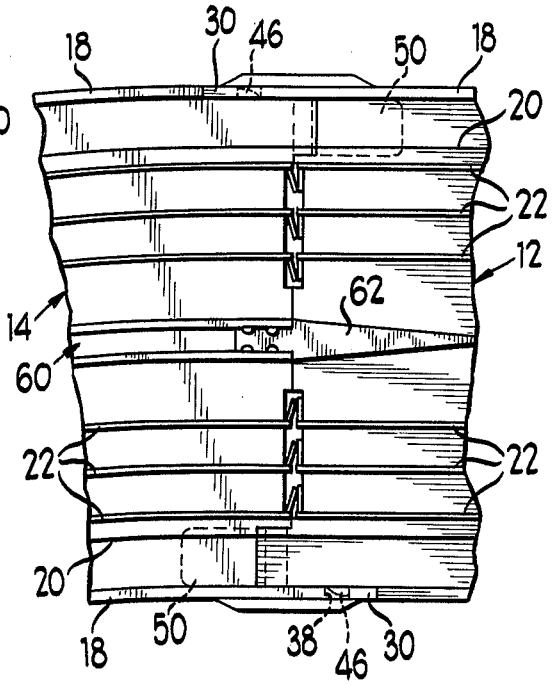

The above described connecting procedure is best shown in FIGS. 4–7 which show the components of a pair of adjacent track sections in their relative dispositions sequentially through FIGS. 4–7 as the sections are connected together. More particularly, FIG. 4 shows a pair of track sections (in this instance, a straight section 12 at the right, and a curved section 14 at the left) completely separated and held in longitudinal alignment for simple longitudinal abutment connection. FIG. 5 shows the two track sections of FIG. 4 moved toward each other end-to-end whereby the vertical edge portion 34 of the flexible arms 30 have become generally in abutment with the rigid bosses 46 of the opposite track section. FIG. 6 shows the two track sections of FIGS. 4 and 5 pushed further against each other end-to-end whereby the curved rigid bosses 46 cam the flexible arms 30 outwardly until, upon further pushing movement as shown in FIG. 7, the flexible arms 30 snap back inwardly toward the center of the track sections as the rigid bosses 46 fall into the recesses 38 of the flexible arms to connect the track sections together and hold the track sections against inadvertent longitudinal separation, with the bent portions 24 of the contact bands 22 also in abutment within recesses 26 as shown in FIG. 7.

The offset vertical edge portions 32 and 34 and the shoulder portion 36 of the flexible arms 30 which are complementary to and abut against the vertical offset edge portions 40 and 42 and the shoulder portions 44 of the opposite outer side wall 18 not only facilitate orienting the adjacent track sections, but these edges and shoulders help to prevent canting or separation of adjacent track sections about their transverse joints, as when one track section is grasped by a user and lifted off of a supporting surface without grasping the adjacent track section.

In addition, each track section is provided with a longitudinally extending tab 50 on the inside of one side wall 18 thereof positionable within the recess 52 formed in the adjacent track section when the track sections are connected together. These tabs 50 and recesses 52 further facilitate stabilizing the trackway and preventing vertical displacement thereof as described in relation to the edge portion 32–34 and 40–44, above. The recesses 52 are formed by a lower cross brace **52*a* and an upper inwardly spaced shoulder portion 52*b* of the recessed portion 20 of the roadbed. The tab 50 is positioned vertically between the cross brace 52*a* and the shoulder portion 52*b* during longitudinal connection of the track sections. The tabs 50 have offset upper and lower shoulders 54 and 56, respectively, for abutting against the shoulder portion 52*b* and lower cross brace portion 52*a* of an adjacent track section. The various longitudinal positions of the tab 50 and recess 52 during longitudinal connection of adjacent track sections is shown in FIGS. 4–7**.

Figure 8:
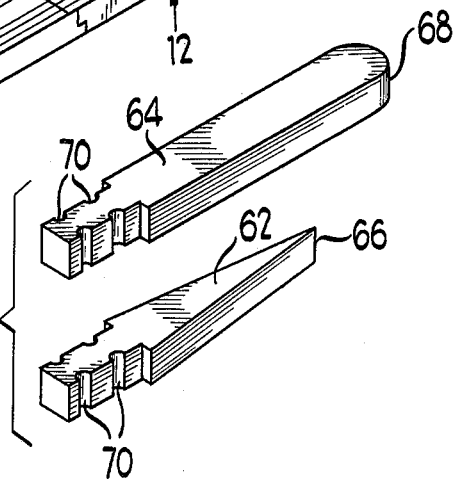
FIG. 8 is a perspective view, on an enlarged scale, of the lane dividers utilized at the entrance and exit to the curved track sections at the ends of the oval trackway shown in FIG. 1.

As mentioned above, simply for exemplary purposes, the lefthand track section shown in FIGS. 4–7 is a curved track section 14 and the righthand track section shown in said FIGS. is a straight track section 12. The trackway shown in the drawings is designed for the purposes of racing toy vehicles whereby two tracks are provided along the trackway defined by the two pairs of three contacts 22. Each of the contact sections 14 have center arced ribs 60 (FIG. 1) to prevent any toy vehicle from jumping one track to the other as passing through the curved portion of the trackway. To this end, and referring to FIG. 8, an entrance piece 62 is provided for overlying an end of an adjacent track section for guiding a racing toy vehicle as it enters the curve of the trackway, as in the direction of arrow A (FIG. 1). The toy vehicles leave the curved portions of the track in the direction of arrow B (FIG. 1), and an exit piece 64 (FIG. 8) is provided for positioning at the exit end of the rib or rail 60. It can be seen that the exit piece diverges from a pointed edge 66 to guide the toy vehicles into the curved tracks of the trackway and the exit piece 64 simply is rounded with a rather blunt end 68. The entrance and exit pieces 62 and 64, respectively, are placed in position by vertical grooves 70 on the inner ends thereof which are positioned over vertical bosses 72 (FIGS. 4–7) to hold the entrance and exit pieces 62 and 64, respectively, in longitudinal disposition overlying the adjacent straight track section 12, as seen in FIG. 7, wherein the two track sections are connected together.

Lastly, in order to disconnect any two adjacent track sections, a user simply manually grasps the opposite flexible arm 30 and pulls the arms outwardly so as to release the rigid bosses 46 from within the recesses 38 of the flexible arms and the track sections are separated in a simple fashion as with the longitudinal abutting connection.

The foregoing detailed description has been given for clearness of understanding only and no unnecessary limitations should be understood therefrom as some modifications will be obvious to those skilled in the art.

We claim:

1. A trackway for toy vehicles including a plurality of elongated track sections, each section having two end faces, an upper surface defining a roadbed for said toy vehicles along the top of said trackway, and complementary engageable connection means for releasably maintaining the track sections in abutment with one another, said connection means comprising:

a generally vertical, flexible, longitudinally extending tab protruding from the end face of said track section and positioned on one side of said track section, said tab including a depression on one side thereof and outwardly of said end face;

detent means on the opposite side of said track section inwardly of said end face for engaging and flexing the flexible tab outwardly and seating within said depression of an adjacent track section automatically in response to longitudinal movement of said track section and abutment of said end faces to secure the track sections against inadvertent longitudinal separation;

a recess formed in the end face of the track section adjacent one side thereof; and a complementary longitudinally extending tab protruding from the end face of said track section for insertion into the recess of an adjacent track section to prevent the adjacent track sections from being canted relative to one another about a transverse axis.

2. The trackway of claim 1 wherein said detent means comprises a generally vertical boss on the side of said track section opposite said flexible tab and having a cam surface directed generally in the same direction as said flexible tab.

3. The trackway of claim 1 wherein said recess is formed adjacent said flexible tab.

4. The trackway of claim 1 wherein said longitudinally extending tab is provided adjacent said detent means.

5. The trackway of claim 1 wherein said longitudinally extending tab comprises a generally horizontal, flat tongue portion having a flat top and bottom surface for interengaging a generally rectangular recess formed in an adjacent track section.

6. The trackway of claim 1 including means on said flexible tab to facilitate manual flexing of said tab to disengage said cam means and release said connection means.

* * * * *